US009889334B2

(12) United States Patent
Ashby et al.

(10) Patent No.: US 9,889,334 B2
(45) Date of Patent: Feb. 13, 2018

(54) DEVICES AND METHODS FOR DETERMINING THE WEIGHT OF A TREADMILL USER

(71) Applicant: ICON Health & Fitness, Inc., Logan, UT (US)

(72) Inventors: Darren Ashby, Richmond, UT (US); Greg Law, Smithfield, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 221 days.

(21) Appl. No.: 14/213,802

(22) Filed: Mar. 14, 2014

(65) Prior Publication Data

US 2014/0302967 A1 Oct. 9, 2014

Related U.S. Application Data

(60) Provisional application No. 61/791,025, filed on Mar. 15, 2013.

(51) Int. Cl.
*A63B 24/00* (2006.01)
*A63B 71/00* (2006.01)
(Continued)

(52) U.S. Cl.
CPC ..... *A63B 22/0235* (2013.01); *A63B 24/0087* (2013.01); *A63B 2220/52* (2013.01);
(Continued)

(58) Field of Classification Search
USPC ..... 482/1, 4, 8–9, 54
See application file for complete search history.

(56) References Cited

U.S. PATENT DOCUMENTS 4,891,764 A * 1/1990 McIntosh ..... 700/183
5,385,519 A * 1/1995 Hsu ..... A63B 22/0023 482/51
(Continued)

FOREIGN PATENT DOCUMENTS

CN 2507503 Y 8/2002
CN 102357284 A 2/2012
(Continued)

OTHER PUBLICATIONS

PCT International Search Report for PCT International Patent Application No. PCT/US2014/029401, dated Jul. 25, 2014.
(Continued)

*Primary Examiner* — Sundhara Ganesan
*Assistant Examiner* — Shila Jalalzadeh Abyane
(74) *Attorney, Agent, or Firm* — Holland & Hart LLP

(57) ABSTRACT

A treadmill may comprise a drive motor positioned and configured to drive a treadbelt, and an electrical current sensor configured to measure the electrical current utilized by the drive motor. The treadmill may also include a computer programmed and configured to analyze the measured electrical current usage by the drive motor to determine the weight of a person positioned on the treadbelt. A person's weight may be determined by driving the treadbelt with the drive motor while a person is positioned on the treadbelt, measuring an electric current utilized by the drive motor, and analyzing the measured electric current to determine the weight of the person positioned on the treadbelt of the treadmill. Additionally, the measured weight may be utilized to calculate calorie expenditure.

15 Claims, 4 Drawing Sheets

(51) Int. Cl.
*A63B 22/02* (2006.01)
*A63B 15/02* (2006.01)

(52) U.S. Cl.
CPC ..... *A63B 2220/58* (2013.01); *A63B 2220/833* (2013.01); *A63B 2230/01* (2013.01); *A63B 2230/75* (2013.01)

(56) References Cited

U.S. PATENT DOCUMENTS

| | | | | |
|---|---|---|---|---|
| 5,852,264 | A * | 12/1998 | Muller | B66B 1/3484 187/281 |
| 6,416,444 | B1 | 7/2002 | Lim et al. | |
| 6,626,803 | B1 | 9/2003 | Oglesby et al. | |
| 2004/0018915 | A1* | 1/2004 | Reyes et al. | 482/1 |
| 2004/0171464 | A1 | 9/2004 | Ashby et al. | |
| 2005/0227820 | A1 | 10/2005 | Dyer et al. | |
| 2008/0032870 | A1* | 2/2008 | Wu | 482/54 |
| 2009/0170663 | A1* | 7/2009 | Cox | A61B 5/1038 482/8 |
| 2010/0216599 | A1 | 8/2010 | Watterson et al. | |
| 2010/0255959 | A1 | 10/2010 | Dalebout et al. | |
| 2011/0098157 | A1* | 4/2011 | Whalen et al. | 482/52 |

FOREIGN PATENT DOCUMENTS

| | | | |
|---|---|---|---|
| CN | 102614624 | A | 8/2012 |
| KR | 2002-0028243 | * | 4/2002 |

OTHER PUBLICATIONS

English Translation of Chinese First Office Action and Search Report issued for 201480023677.5 dated Jul. 29, 2016.

English translation of the abstract of CN102614624A. Dated Aug. 1, 2012.

English translation of the abstract of CN2507503Y. Dated Aug. 28, 2002.

English translation of the abstract of CN102357284A. Dated Feb. 22, 2012.

* cited by examiner

DEVICES AND METHODS FOR DETERMINING THE WEIGHT OF A TREADMILL USER

CROSS-REFERENCE TO RELATED APPLICATIONS

This application claims priority to U.S. Provisional Patent application 61/791,025 filed on Mar. 15, 2013.

TECHNICAL FIELD

The present disclosure relates to exercise equipment. More particularly, the present disclosure relates to treadmills and methods of determining the weight of a user on a treadmill.

BACKGROUND

The weight of a user may be required to utilize various features of a treadmill. For example, the calorie expenditure by a user while exercising on a treadmill may be more accurately estimated by utilizing the weight of the user. In view of this, prior to each use of a treadmill, a user may be required to input their current weight. This may be cumbersome and time consuming to the user, and requires that the user accurately know their current weight. Accordingly, a user may unintentionally input an inaccurate weight.

Also, it may be embarrassing to a user to enter their weight into a treadmill located in view of others, such as at a fitness club or gym, and disclose their current weight. Thus, the person may intentionally input an inaccurate weight to avoid disclosing their current weight to others. Accordingly, in addition to being a time consuming annoyance to users, requiring a user to enter their current weight via a treadmill console may result in inaccurate and unreliable results.

In view of the foregoing, it would be desirable to be able to acquire the weight of a treadmill user without requiring the user to input their weight manually into the treadmill. Additionally, it would be desirable to be able to calculate a reasonably accurate calorie expenditure by a user on a treadmill without first requesting that the user input their weight manually.

SUMMARY

In one aspect of the disclosure, a method of determining a person's weight may comprise driving a treadbelt of a treadmill with a drive motor while a person is positioned on the treadbelt, measuring an electric current utilized by the drive motor, and analyzing the measured electric current to determine the weight of the person positioned on the treadbelt of the treadmill.

In one or more other aspects that may be combined with any of the aspects herein, may further include positioning the treadbelt to simulate a declining slope.

In one or more other aspects that may be combined with any of the aspects herein, may further include positioning the treadbelt to simulate an inclining slope.

In one or more other aspects that may be combined with any of the aspects herein, may further include analyzing the measured electric current to determine the weight of the person positioned on the treadbelt of the treadmill by comparing the measured electric current to a value on a lookup table.

In one or more other aspects that may be combined with any of the aspects herein, may further include analyzing the measured electric current to determine the weight of the person positioned on the treadbelt of the treadmill by inputting the measured electric current into a mathematical function.

In one or more other aspects that may be combined with any of the aspects herein, may further include driving the treadbelt of the treadmill with the drive motor while the person is positioned on the treadbelt by driving the treadbelt at a linear speed less than about 2.25 meters per second.

In one or more other aspects that may be combined with any of the aspects herein, may further include analyzing the measured electric current by analyzing an average measured electric current over a period of time.

In one or more other aspects that may be combined with any of the aspects herein, may further include determining a cadence of the person positioned on the treadbelt.

In one or more other aspects that may be combined with any of the aspects herein, may further include analyzing an average measured electric current over a period of time by analyzing an average measured electric current over a period of time corresponding to the determined cadence.

In one or more other aspects that may be combined with any of the aspects herein, may further include changing the slope of the treadbelt while measuring the electric current utilized by the drive motor.

In one aspect of the present disclosure, a method of calculating calories expended while exercising on a treadmill may include measuring the weight of a person on a treadmill, and utilizing the determined weight to calculate calorie expenditure.

In one or more other aspects that may be combined with any of the aspects herein, may further include automatically determining the weight of the person on the treadmill by driving a treadbelt of the treadmill with a drive motor while the person is positioned on the treadbelt, measuring an electric current utilized by the drive motor, and analyzing the measured electric current to determine the weight of the person positioned on the treadbelt of the treadmill.

In one or more other aspects that may be combined with any of the aspects herein, may further include positioning the treadbelt to simulate a declining slope.

In one or more other aspects that may be combined with any of the aspects herein, may further include analyzing the measured electric current to determine the weight of the person positioned on the treadbelt of the treadmill by comparing the measured electric current to a value on a lookup table.

In one or more other aspects that may be combined with any of the aspects herein, may further include analyzing the measured electric current to determine the weight of the person positioned on the treadbelt of the treadmill by inputting the measured electric current into a mathematical function.

In one or more other aspects that may be combined with any of the aspects herein, may further include driving the treadbelt of the treadmill with the drive motor while the person is positioned on the treadbelt by driving the treadbelt at a linear speed less than about 2.25 meters per second.

In one or more other aspects that may be combined with any of the aspects herein, may further include analyzing the measured electric current by analyzing an average measured electric current over a period of time.

In one or more other aspects that may be combined with any of the aspects herein, may further include determining a cadence of the person positioned on the treadbelt.

In one aspect of the disclosure, a treadmill may comprise a platform, a treadbelt extending over the platform, a drive motor positioned and configured to drive the treadbelt, an electrical current sensor configured to measure the electrical current utilized by the drive motor, and a computer programmed and configured to analyze measured electrical current usage by the drive motor to determine the weight of a person positioned on the treadbelt.

In one or more other aspects that may be combined with any of the aspects herein, may further include a rear deck height adjustment mechanism, and a front deck height adjustment mechanism.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
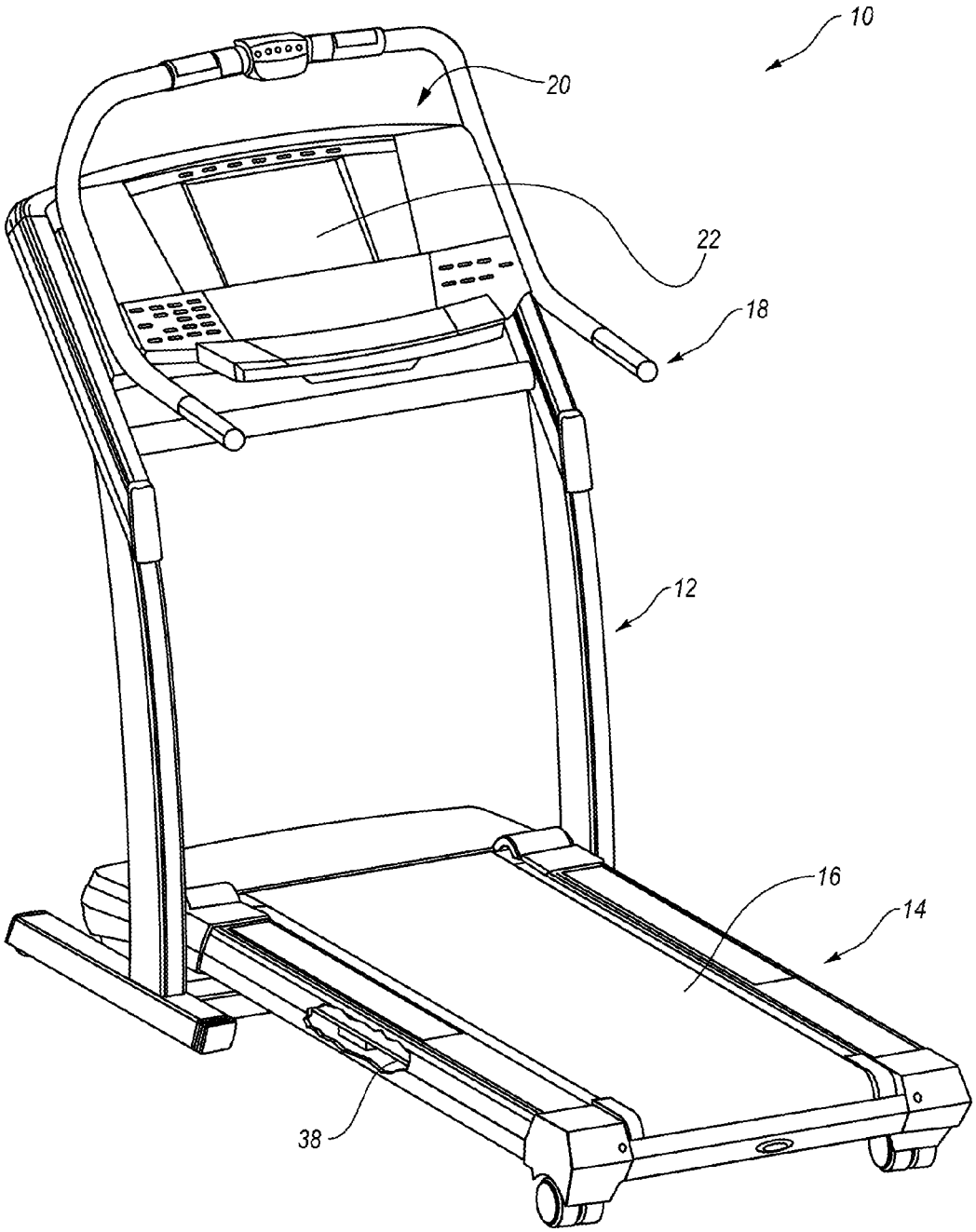
FIG. 1 is a perspective view of a treadmill configured to automatically determine the weight of a user, according to an embodiment of the present disclosure.

In some embodiments, as shown in FIG. 1, a treadmill 10 may include a frame 12 and a deck 14 having a front end pivotally attached to the frame 12. The deck 14 may include a treadbelt 16 that is exposed at an upper region of the deck and provides a movable, continuous running surface during operation of the treadmill 10. Additionally, the frame 12 may include one or more handrails 18 to provide support and balance to a user.

The treadmill 10 may additionally include a console 20. The console 20 may be mounted on the frame 12 of the treadmill 10 so that it may be readily accessible and viewable to a user positioned on the treadmill 10. The console 20 may include inputs and outputs to allow the user to communicate with the treadmill 10 via the console 20. The console 20 may include a visual display, such as a video screen 22 to provide visual communication to the user. The console 20 may also include an audio output, such as an audio jack for the connection of headphones and/or a speaker, to provide audio communication to the user. Input devices may facilitate the entry of data by a user, such as a desired operating speed for the treadbelt, a desired incline, and information about the user. For example, the inputs of the console may include one or more of buttons, a touch screen, a microphone, and a camera for inputting information through the console 20.

Figure 2:
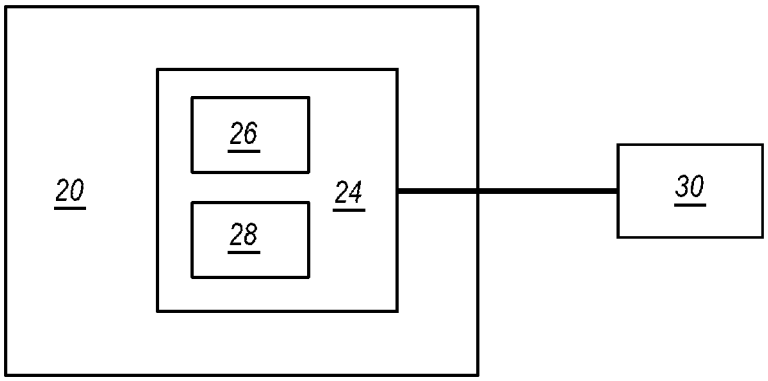
FIG. 2 is a schematic view of a computer and sensor arrangement of the treadmill of FIG. 1.

The console 20 may include a computer 24 located therein, which may include a processor 26 and a memory 28, as illustrated in FIG. 2. In further embodiments, the computer 24 may not be located in the console 20, but may be in communication with the console 20. The computer 24 may be configured to receive data from the inputs of the console 20 and from sensors 30 of the treadmill 10.

Figure 3:
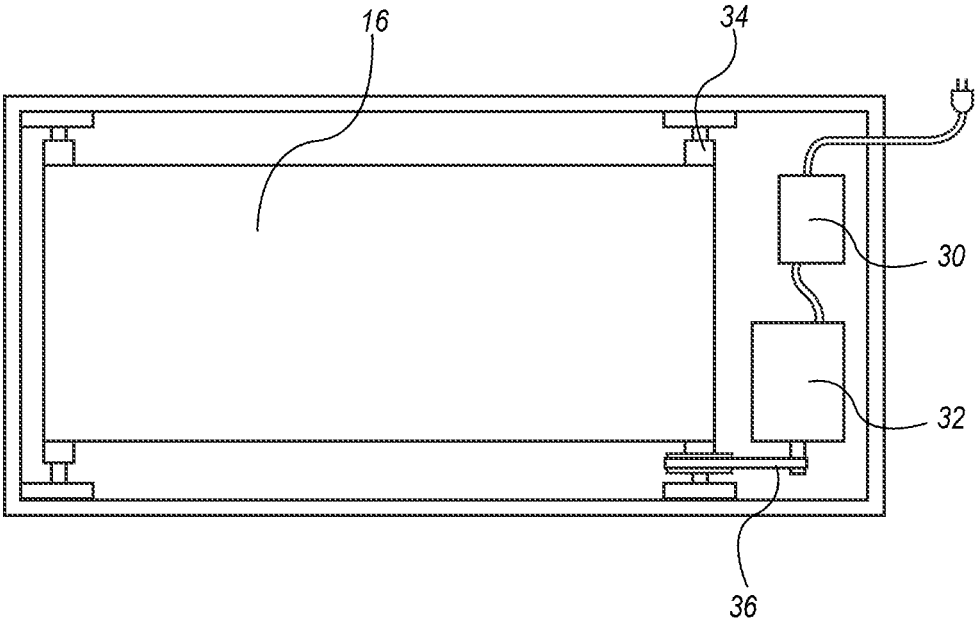
FIG. 3 is a top view of a drive mechanism of the treadmill of FIG. 1.

As shown in FIG. 3, a drive motor 32 may be associated with the treadbelt 16. The drive motor 32 may be positioned and configured to drive the treadbelt 16. For example, the drive motor 32 may be connected to a roller 34 via a drive belt 36 and the treadbelt 16 may be positioned over the roller 34.

The treadmill 10 may also include one or more sensors for collecting data while a user is running and/or walking on the treadbelt of the treadmill. For example, a sensor 30 may be positioned and configured to sense the electrical current utilized by the drive motor 32. The computer 24 may be configured to receive data from the sensor 30 and to analyze the data with the processor 26.

Figure 4:
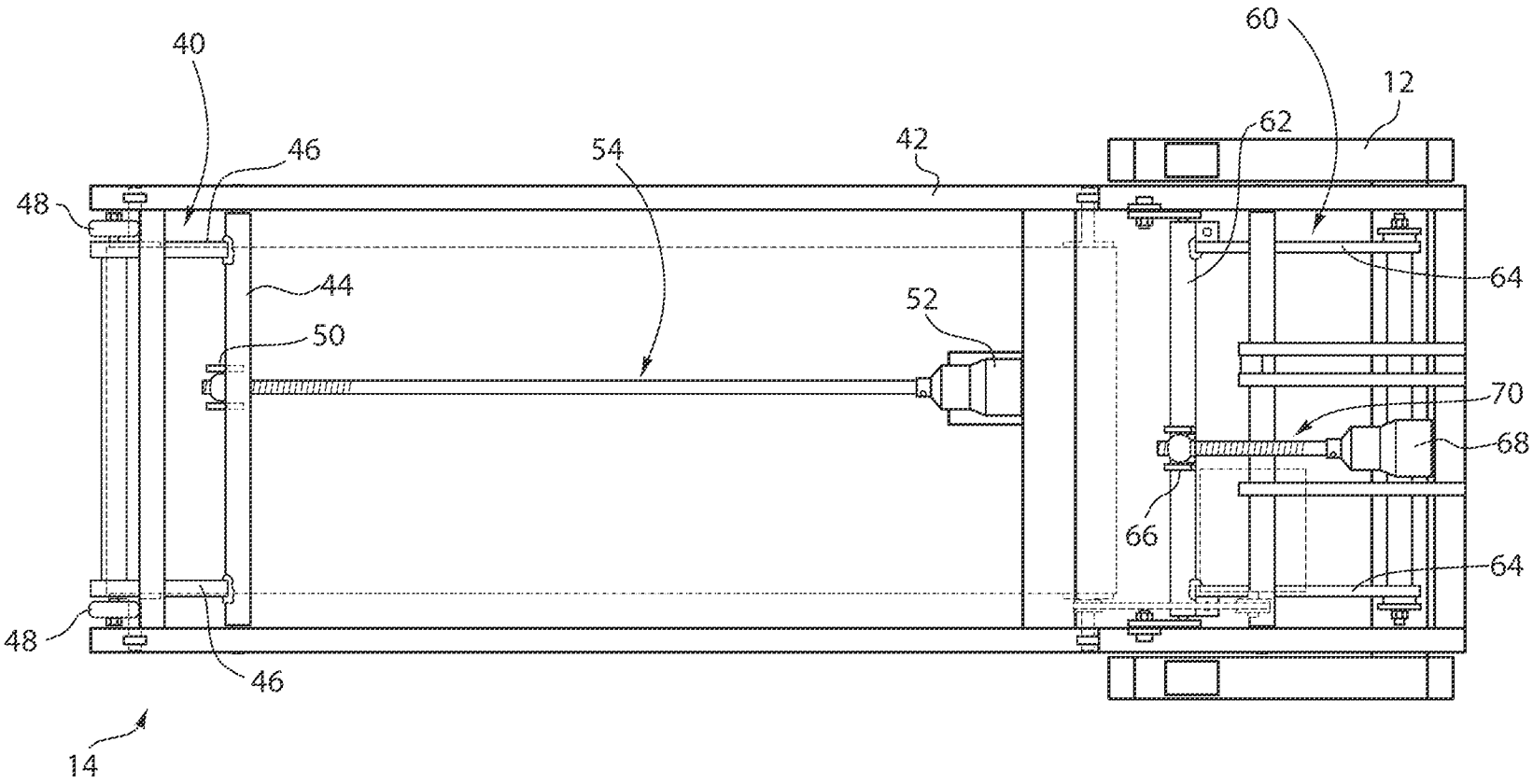
FIG. 4 is a top view of deck height adjustment mechanisms of the treadmill of FIG. 1.

As shown in FIG. 4, the deck 14 may be supported by a deck frame 42, which may include a left side rail and a right side rail connected by laterally extending cross-members. A front roller may be rotatably coupled to and extend between the side rails at a front end of the deck. Likewise, a rear roller may be rotatably coupled to and extend between the side rails at a rear end of the deck 14. Additionally, a support surface 38 (see FIG. 1) may be coupled to and extend between the side rails at a location between the front and rear rollers. The treadbelt 16 may be routed around the rollers and the support surface 38, to provide a continuous running surface.

A rear deck height adjustment mechanism 40 may be located at a rear end of the deck 14. In one embodiment, the rear deck height adjustment mechanism 40 may be rotatably coupled to the side rails of a deck frame 42. The rear deck height adjustment mechanism 40 may comprise a cross-bar 44, and legs 46 extending from the cross-bar. Each leg 46 may include a wheel 48 positioned to contact the floor underlying the treadmill 10.

A lever arm 50 may extend from a central region of the cross-bar 44 of the rear deck height adjustment mechanism 40. Accordingly, when a force is applied to the lever arm 50 a torque may be applied to the rear deck height adjustment mechanism 40 and the legs 46 of the rear deck height adjustment mechanism 40 may rotate relative to the deck frame 42.

A first motor 52, for operating the rear deck height adjustment mechanism 40, may be located at the front end of the deck 14. An elongate power transmission device 54 may extend from the first motor 52 to the lever 50 of the rear deck height adjustment mechanism 40. For example, the elongate power transmission device 54 may comprise a screw extending from the first motor 52 located at the front of the deck 14 to the lever 50 of the rear deck height adjustment mechanism 40. A nut may be hinged to the lever 50 of the rear deck height adjustment mechanism 40, and the screw may extend through the nut. Accordingly, helical threads of the screw may be intermeshed with corresponding helical threads of the nut.

A front deck height adjustment mechanism 60 may be located at a front end of the deck 14. In one embodiment, the front deck height adjustment mechanism 60 may be rotatably coupled to the side rails of the deck frame 42. The front deck height adjustment mechanism 60 may comprise a cross-bar 62, and arms 64 extending from the cross-bar 62. Each of the arms 64 may also be rotatably coupled to the frame 12 of the treadmill 10.

A lever arm 66 may extend from a central region of the cross-bar 62 of the front deck height adjustment mechanism 60. Accordingly, when a force is applied to the lever arm 66 a torque may be applied to the front deck height adjustment mechanism 60 and the arms 64 of the front deck height adjustment mechanism 60 may rotate relative to the deck frame 42 and the frame 12 of the treadmill 10.

A second motor 68, for operating the front deck height adjustment mechanism 60, may be located at the front end of the deck 14. A power transmission device 70 may extend from the motor 68 to the lever 66 of the front deck height adjustment mechanism 60. For example, a screw may extend from the motor 68 to the lever 66 of the front deck height adjustment mechanism 60. A nut may be hinged to the lever 66 of the front deck height adjustment mechanism 60, and the screw may extend through the nut. Accordingly, helical threads of the screw may be intermeshed with corresponding helical threads of the nut.

In some embodiments, a lift assist device (not shown), for facilitating the movement of the deck between the operating position and the storage position, may extend between the deck frame 42 and the frame 12 of the treadmill 10.

For a particular treadmill design, empirical data may be collected by operating the treadmill 10 with users of various weights positioned on the treadbelt 16. Optionally, weight may be incrementally applied to a user positioned on the treadbelt 16 of the treadmill 10 to collect empirical data. While the user is positioned on the treadbelt 16, the treadbelt 16 may be moved by the drive motor 32 and the electrical current utilized by the drive motor 32 may be measured by the sensor 30 and recorded by the computer 24.

The angle of the deck 14, and thus the treadbelt 16, may be selected that may facilitate distinguishable data signals collected from users of differing weight. For example, the deck 14 angle may be positioned at a decline, simulating a declining slope (i.e., simulating walking downhill).

In operation, a user may power on the treadmill 10, such as by pressing a button on the console 20, or by inserting a safety key into a receptacle in the console 20. The user's feet may be positioned on the treadbelt 16 of the treadmill 10 and the treadmill 10 may begin a weight determination procedure.

To determine the user's weight, the drive motor 32 may drive the treadbelt 16 while the user is positioned on the treadbelt 16. As the treadbelt 16 is driven with the drive motor 32, the user may begin to walk. As a non-limiting example, the treadbelt 16 may be driven at a linear speed less than about 2.25 meters per second.

As the user walks on the treadbelt 16, the electric current utilized by the drive motor 32 may be measured with the sensor 30. The measured electric current may then be analyzed by the computer 24 to determine the weight of the user positioned on the treadbelt 16 of the treadmill 10.

In order to collect electric current data that may provide a more accurate and reliable weight determination, the treadbelt 16 may be positioned to simulate a slope, such as an inclining slope or a declining slope. Optionally, the slope of the treadbelt 16 may be changed while measuring the electric current utilized by the drive motor 32.

In some embodiments, analyzing the measured electric current to determine the weight of the person positioned on the treadbelt 16 of the treadmill 10 may comprise comparing the measured electric current to a value on a lookup table, which may be stored in the memory 28 of the computer 24. In further embodiments, analyzing the measured electric current to determine the weight of the user positioned on the treadbelt 16 of the treadmill 10 may comprise inputting the measured electric current into a mathematical function with the computer 24.

Additionally, an average measured electric current over a period of time may be analyzed to improve accuracy and reliability. The cadence of the user walking on the treadbelt 16 may be determined by measuring cyclic features of the data, such as peaks in energy usage. The determined cadence of the user may then be utilized to analyze an average measured electric current, such as an average maximum current (i.e., peak current) or an average minimum current, over a period of time that corresponds to the user's cadence.

After a user's weight has been automatically determined, the determined weight may be utilized by the computer 24 to calculate calories expended by the user while exercising on the treadmill. The calorie expenditure may then be displayed via the console. Optionally, if the user desires, the determined weight may also be displayed via the console.

Figure 5:
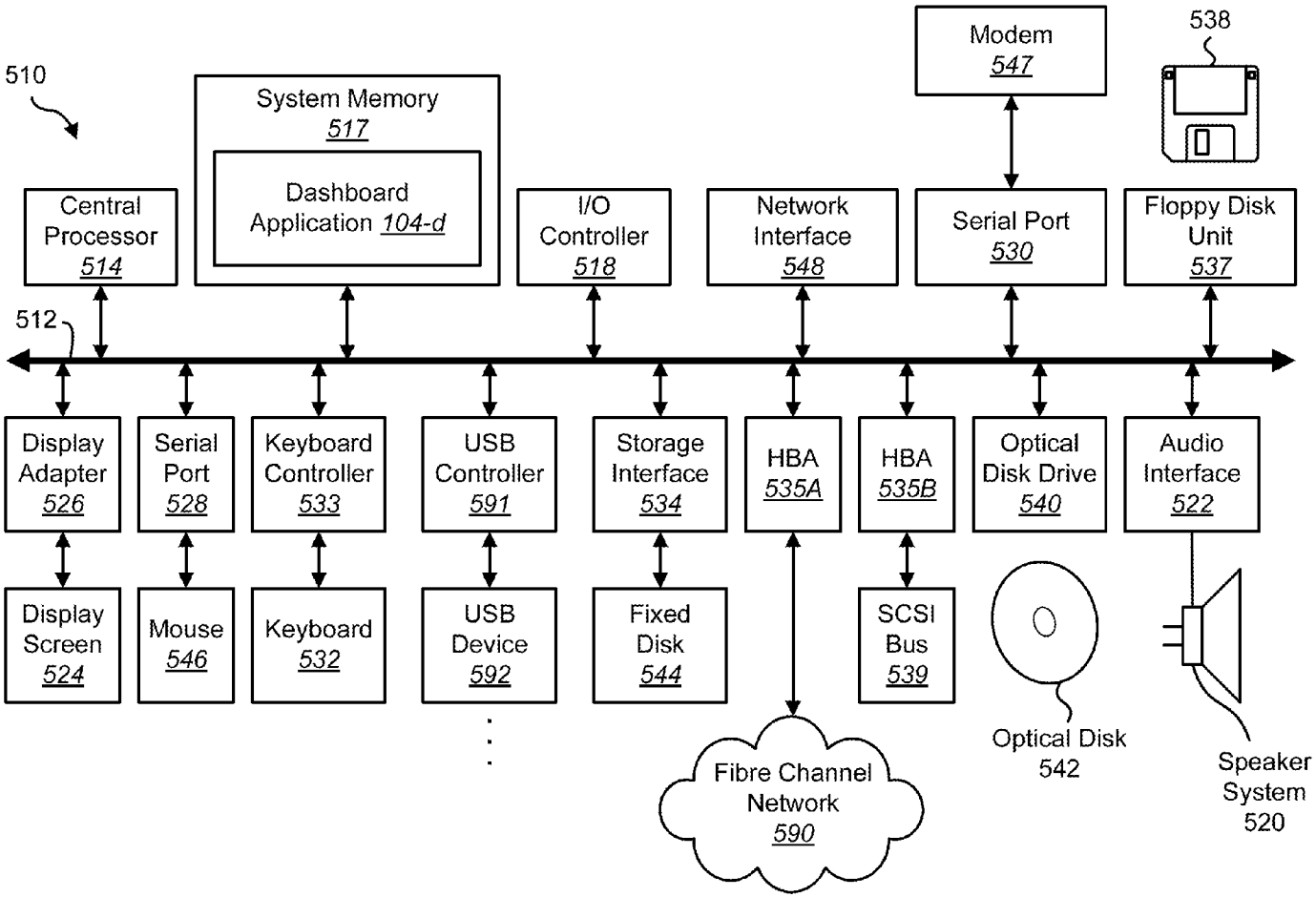
FIG. 5 depicts a block diagram of a computer system suitable for implementing the present systems and methods.

FIG. 5 depicts a block diagram of a computer system 510 suitable for implementing the present systems and methods. Computer system 510 includes a bus 512 which interconnects major subsystems of computer system 510, such as a central processor 514, a system memory 517 (typically RAM, but which may also include ROM, flash RAM, or the like), an input/output controller 518, an external audio device, such as a speaker system 520 via an audio output interface 522, an external device, such as a display screen 524 via display adapter 526, serial ports 528 and 530, a keyboard 532 (interfaced with a keyboard controller 533), multiple USB devices 592 (interfaced with a USB controller 591), a storage interface 534, a floppy disk unit 537 operative to receive a floppy disk 538, a host bus adapter (HBA) interface card 535A operative to connect with a Fibre Channel network 590, a host bus adapter (HBA) interface card 535B operative to connect to a SCSI bus 539, and an optical disk drive 540 operative to receive an optical disk 542. Also included are a mouse 546 (or other point-and-click device, coupled to bus 512 via serial port 528), a modem 547 (coupled to bus 512 via a serial port), and a network interface 548 (coupled directly to bus 512).

Bus 512 allows data communication between central processor 514 and system memory 517, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the application to implement the present systems and methods may be stored within the system memory 517. The application may compute the weight determination methodologies described above with reference to FIGS. 1-4 based on signals received from the current sensor. Additionally, the ROM or flash memory may contain any number of lookup tables used to determine a user's weight. Applications resident with computer system 510 are generally stored on and accessed via a non-transitory computer readable medium, such as a hard disk drive (e.g., fixed disk 544), an optical drive (e.g., optical drive 540), a floppy disk unit 537, or other storage medium. Additionally, applications can be in the form of electronic signals modulated in accordance with the application and data communication technology when accessed via network modem 547 or interface 548.

Storage interface 534, as with the other storage interfaces of computer system 510, can connect to a standard computer readable medium for storage and/or retrieval of information, such as a fixed disk drive 544. Fixed disk drive 544 may be a part of computer system 510 or may be separate and accessed through other interface systems. Modem 547 may provide a direct connection to a remote server via a telephone link or to the Internet via an internet service provider (ISP). Network interface 548 may provide a direct connection to a remote server via a direct network link to the Internet via a POP (point of presence). Network interface 548 may provide such connection using wireless techniques, including digital cellular telephone connection, Cellular Digital Packet Data (CDPD) connection, digital satellite data connection or the like.

Many other devices or subsystems (not shown) may be connected in a similar manner (e.g., GPS devices, digital cameras and so on). Conversely, all of the devices shown in FIG. 5 need not be present to practice the present systems and methods. The devices and subsystems can be interconnected in different ways from that shown in FIG. 5. The operation of a computer system such as that shown in FIG. 5 is readily known in the art and is not discussed in detail in this application. Code to implement the present disclosure can be stored in a non-transitory computer-readable medium such as one or more of system memory 517, fixed disk 544, optical disk 542, or floppy disk 538. The operating system provided on computer system 510 may be MS-DOS®, MS-WINDOWS®, OS/2®, UNIX®, Linux®, or another known operating system.

INDUSTRIAL APPLICABILITY

The weight of a user may be required to utilize various features of a treadmill. For example, the calorie expenditure by a user while exercising on a treadmill may be more accurately estimated by utilizing the weight of the user. In view of this, prior to each use of a treadmill, a user may be required to input their current weight. This may be cumbersome and time consuming to the user, and requires that the user accurately know their current weight. Accordingly, a user may unintentionally input an inaccurate weight.

Also, it may be embarrassing to a user to enter their weight into a treadmill located in view of others, such as at a fitness club or gym, and disclose their current weight. Thus, the person may intentionally input an inaccurate weight to avoid disclosing their current weight to others. Accordingly, in addition to being a time consuming annoyance to users, requiring a user to enter their current weight via a treadmill console may result in inaccurate and unreliable results.

To address the foregoing issues, the methods and devices disclosed herein enable the acquisition of the weight of a treadmill user without requiring the user to input their weight manually into the treadmill. Additionally, the methods and devices disclosed herein enable the calculation of a reasonably accurate calorie expenditure by a user on a treadmill without first requesting that the user input their weight manually.

A treadmill may include a base and a deck having a front end pivotally attached to the base. The deck may include a treadbelt that is exposed at an upper region of the deck and provides a movable, continuous running surface during operation of the treadmill. Additionally, the frame may include one or more handrails to provide support and balance to a user.

The treadmill may additionally include a console, and the console may include a computer located therein, which may include a processor and a memory. In further embodiments, the computer may not be located in the console, but may be in communication with the console. The computer may be configured to receive data from the inputs of the console and from sensors located about the treadmill.

A drive motor may be associated with the treadbelt. The drive motor may be positioned and configured to drive the treadbelt. For example, the drive motor may be connected to a roller via a drive belt and the treadbelt may be positioned over the roller.

A rear deck height adjustment mechanism may be located at a rear end of the deck, and a front deck height adjustment mechanism may be located at a front end of the deck The treadmill may also include one or more sensors for collecting data while a user is running and/or walking on the treadbelt of the treadmill. For example, a sensor may be positioned and configured to sense the electrical current utilized by the drive motor. The computer may be configured to receive data from the sensor and to analyze the data with the processor.

For a particular treadmill design, empirical data may be collected by operating the treadmill with users of various weights positioned on the treadbelt. Optionally, weight may be incrementally applied to a user positioned on the treadbelt of the treadmill to collect empirical data. While the user is positioned on the treadbelt, the treadbelt may be moved by the drive motor and the electrical current utilized by the drive motor may be measured and recorded.

The angle of the deck, and thus the treadbelt, may be selected that may facilitate distinguishable data signals collected from users of differing weight. For example, the deck angle may be positioned at a decline, simulating a declining slope (i.e., simulating walking downhill).

In operation, a user may power on the treadmill, such as by pressing a button on the console, or by inserting a safety key into a receptacle in the console. The user's feet may be positioned on the treadbelt of the treadmill and the treadmill may begin a weight determination procedure.

To determine the user's weight, the drive motor may drive the treadbelt while the user is positioned on the treadbelt. As the treadbelt is driven with the drive motor, the user may begin to walk. As a non-limiting example, the treadbelt may be driven at a linear speed less than about 2.25 meters per second.

As the user walks on the treadbelt, the electric current utilized by the drive motor may be measured with the sensor. The measured electric current may then be analyzed by the computer to determine the weight of the user positioned on the treadbelt of the treadmill.

In order to collect electric current data that may provide a more accurate and reliable weight determination, the treadbelt may be positioned to simulate a slope, such as an inclining slope or a declining slope. Optionally, the slope of the treadbelt may be changed while measuring the electric current utilized by the drive motor.

In some embodiments, analyzing the measured electric current to determine the weight of the person positioned on the treadbelt of the treadmill may comprise comparing the measured electric current to a value on a lookup table, which may be stored in the memory of the computer. In further embodiments, analyzing the measured electric current to determine the weight of the user positioned on the treadbelt of the treadmill may comprise inputting the measured electric current into a mathematical function with the computer.

Additionally, an average measured electric current over a period of time may be analyzed to improve accuracy and reliability. The cadence of the user walking on the treadbelt may be determined by measuring cyclic features of the data, such as peaks in energy usage. The determined cadence of the user may then be utilized to analyze an average measured electric current over a period of time that corresponds to the user's cadence.

After a user's weight has been automatically determined, the determined weight may be utilized to calculate calories expended by the user while exercising on the treadmill.

What is claimed is:

1. A method of determining a person's weight, the method comprising:

driving, by a drive motor, a treadbelt of a treadmill while a person is exercising on the treadbelt;

measuring, by a sensor, an electric current utilized by the drive motor over a period of time that the person exercises on the treadbelt as the treadbelt is driven by the drive motor;

changing a slope of the treadbelt while measuring the electric current utilized by the drive motor;

analyzing, by a computer, the measured electric current; and determining, by the computer and based on the analysis of the measured electric current, a weight value that is the weight of the person positioned on the treadbelt of the treadmill.

2. The method of claim 1, wherein analyzing the measured electric current further comprises:

analyzing an average measured electric current over the period of time that the person exercises on the treadbelt.

3. The method of claim 2, further comprising determining a cadence of the person positioned on the treadbelt.

4. The method of claim 3, wherein analyzing an average measured electric current comprises:

analyzing an average measured electric current corresponding to the determined cadence.

5. The method of claim 1, further comprising positioning the treadbelt to simulate a declining slope.

6. The method of claim 1, further comprising positioning the treadbelt to simulate an inclining slope.

7. The method of claim 1, wherein determining a weight value of the person comprises:

comparing, by the computer, the measured electric current to a value on a lookup table.

8. The method of claim 1, wherein determining a weight value of the person comprises inputting the measured electric current into a mathematical function.

9. The method of claim 1, wherein driving the treadbelt of the treadmill with the drive motor while the person is positioned on the treadbelt comprises driving the treadbelt at a linear speed less than about 2.25 meters per second.

10. A method of calculating calories expended by a person while exercising on a treadmill, the method comprising:

driving, by a drive motor, a treadbelt of the treadmill while the person is positioned on the treadbelt;

positioning the treadbelt to simulate a declining slope;

measuring, by a sensor, an electric current utilized by the drive motor over a period of time that the person exercises on a treadbelt of the treadmill while the treadbelt is driven by the motor;

changing the slope of the treadbelt while measuring the electric current utilized by the drive motor;

analyzing, by a computer, the measured electric current;

determining, by the computer and based on the analysis of the measure electric current, a weight of the person positioned on the treadbelt of the treadmill; and calculating, by the computer, calorie expenditure using the determined weight of the person.

11. The method of claim 10, wherein analyzing the measured electric current further comprises:

analyzing an average measured electric current over the period of time that the person exercises on the treadbelt.

12. The method of claim 11, further comprising determining a cadence of the person positioned on the treadbelt.

13. The method of claim 10, wherein determining a weight of the person comprises comparing the measured electric current to a value on a lookup table.

14. The method of claim 10, wherein determining a weight of the person comprises inputting the measured electric current into a mathematical function.

15. The method of claim 10, wherein driving the treadbelt of the treadmill with the drive motor while the person is positioned on the treadbelt comprises driving the treadbelt at a linear speed less than about 2.25 meters per second.

* * * * *